US005950719A

United States Patent [19]

Dubrovin et al.

[11] Patent Number: 5,950,719

[45] **Date of Patent: *Sep. 14, 1999**

[54] FLUID-CIRCULATION HEAT EXCHANGER, IN PARTICULAR FOR AN ELECTRON TUBE

[75] Inventors: Alexis Dubrovin, Paris; Philippe Denis, Choisy le Roi; Jean-Jacques Pelletier, Le Krmlin Bicetre; Jean-Claude Lixon, L'Hay les Roses, all of France

[73] Assignee: Thomson Tubes Electroniques, Meudon la Foret, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/687,449

[22] PCT Filed: Feb. 2, 1995

[86] PCT No.: PCT/FR95/00130

§ 371 Date: Aug. 15, 1996

§ 102(e) Date: Aug. 15, 1996

[87] PCT Pub. No.: WO95/22038

PCT Pub. Date: Aug. 17, 1995

[30] Foreign Application Priority Data

Feb. 15, 1994 [FR] France ..... 94 01692

[51] Int. Cl.[6] ..... F28D 7/10

[52] U.S. Cl. ..... 165/154; 165/10; 165/181; 165/907

[58] Field of Search ..... 165/154, 907, 165/10, 9.1, 104.16, 181

[56] References Cited

U.S. PATENT DOCUMENTS

| | | | |
|---|---|---|---|
| 2,401,797 | 6/1946 | Rasmussen | 165/907 |
| 2,448,315 | 8/1948 | Kuzog | 165/907 |
| 3,493,042 | 2/1970 | Burne et al. | 165/181 |
| 3,595,310 | 7/1971 | Burne et al. | 165/181 X |
| 3,948,316 | 4/1976 | Souriau | 165/907 X |
| 5,062,474 | 11/1991 | Joshi | 165/154 X |
| 5,180,001 | 1/1993 | Okada et al. | 165/907 X |
| 5,231,968 | 8/1993 | Siefkes | 165/907 X |
| 5,257,757 | 11/1993 | Paul et al. | 165/154 X |
| 5,271,087 | 12/1993 | Schmid | 165/907 X |

FOREIGN PATENT DOCUMENTS

| | | | |
|---|---|---|---|
| 0125396 | 7/1984 | Japan | 165/907 |
| 0066093 | 4/1985 | Japan | 165/907 |
| 1256793 | 10/1989 | Japan | 165/907 |
| 0008691 | 1/1990 | Japan | 165/907 |
| 4143526 | 5/1995 | Japan | 165/907 |
| 1112216 | 9/1984 | U.S.S.R. | 165/907 |
| 5 31112 | 12/1940 | United Kingdom | 165/907 |

*Primary Examiner*—Christopher Atkinson
*Attorney, Agent, or Firm*—Oblon, Spivak, McClelland, Maier & Neustadt, P.C.

[57] ABSTRACT

A fluid-circulation heat exchanger including a porous body, made of thermally conductive material, in contact with at least one portion of a part to be cooled. The fluid flows through this porous body. The porous body has pores which generate directional changes of the fluid. These pores are large enough for the head loss of the fluid to be as small as possible on passage through the porous body. Application, in particular, to electron tubes.

20 Claims, 6 Drawing Sheets

FLUID-CIRCULATION HEAT EXCHANGER, IN PARTICULAR FOR AN ELECTRON TUBE

BACKGROUND OF THE INVENTION

1. Field of the Invention

The present invention relates to a fluid-circulation heat exchanger, in particular for an electron tube. Some electron tubes have high thermal stresses. These stresses are associated with two types of factors: either the intended average power performances are at the limit of known cooling systems, or the allowed size does not make it possible to develop appropriate heat exchangers.

2. Discussion of the Background

In gridded microwave tubes, it is the anode which requires efficient cooling; in linear-beam tubes it is, in particular, the collector which must be cooled, and also the drift tubes and the cavity ports in klystrons or travelling-wave tubes with coupled cavities. Crossed-field tubes must also be cooled at their anode. As regards fast-wave tubes such as gyrotrons, it is the cavity and/or the collector which requires effective cooling.

Those heat exchangers with the best performance which are currently used operate with a fluid.

In some heat exchangers, the part to be cooled is immersed in the fluid, which is often water. This type of exchanger is limited in terms of heat-flux density because a vapour film causes stagnation at the surface of the part to be cooled. This is the burn-out phenomenon. This vapour has low thermal conductivity. The part consequently heats up enormously and the heat exchanger no longer fulfils its function. This temperature rise may lead to destruction of the part to be cooled.

One known solution consists in using a forced fluid stream at high flow rate and high pressure around the part, but this requires voluminous and expensive equipment with a compressor whose energy consumption is far from negligible. These heat exchangers nevertheless have high performance.

Another solution consists in using heat exchangers of the VAPOTRON or derived type. The term VAPOTRON is a registered trademark belongs to the company Thomson SA. They use vaporization of the liquid in contact with a hot wall, this wall being provided with reliefs which promote pulsed expulsion of the vapour, which alternately provides access of the liquid against the wall to be cooled. Liquid circulation compatible with the mains distribution is sufficient.

These heat exchangers have only made it possible to achieve continuous heat-flux densities of 1 $kW/cm^2$ and, exceptionally, 2 $kW/cm^2$. These performances are poorer than those of forced-circulation exchangers, but they do not require an installation delivering a forced steam of fluid. However, these heat exchangers are relatively heavy and expensive because of the bulky relief wall.

Document JP-A-53 91 164 discloses a porous body formed by thin tubes grouped in a bunch in a pipe and assembled together with the aid of molten metal.

SUMMARY OF THE INVENTION

The object of the present invention is to overcome these drawbacks. It proposes a heat exchanger which is capable of extracting heat-flux densities which are much greater than those of exchangers of the VAPOTRON type and which do not require a forced-circulation installation with high flow rate and high pressure. Furthermore, because of its high performance, this heat exchanger makes it possible to reduce the surface area of the part to be cooled. This fluid-circulation heat exchanger includes a porous body in contact with at least one portion of the part to be cooled, this porous body, made of a thermally conductive material, has pores which generate directional changes of the fluid as it passes through the porous body and which are sufficiently large for the head loss of the fluid during its passage through the porous body to be as small as possible.

The porous body may be made of a honeycombed material with communicating cells or be formed by an interlaced wire. In another variant, the porous body may be formed by a succession of partitions pierced with openings.

It is also possible for the part to be cooled and the porous body to form an integral unit.

Advantageously, the porous body may be formed by a plurality of elements pierced through by at least one hole, these elements being in contact with one another.

The pierced elements are preferably tubular with a diameter substantially equal to their height.

Also preferably, the thickness of the pierced elements is as thin as possible, so as to minimize the head loss of the fluid without prejudicing the mechanical strength of the assembly. A heat exchanger according to the invention may operate with water whose pressure and flow rate are compatible with those of the mains distribution network.

These porous body configurations are particularly simple, inexpensive and lightweight.

BRIEF DESCRIPTION OF THE DRAWINGS

Other characteristics and advantages of the invention will emerge when reading the following description, which is illustrated by the appended figures, in which.

DESCRIPTION OF THE PREFERRED EMBODIMENTS

Figure 1:
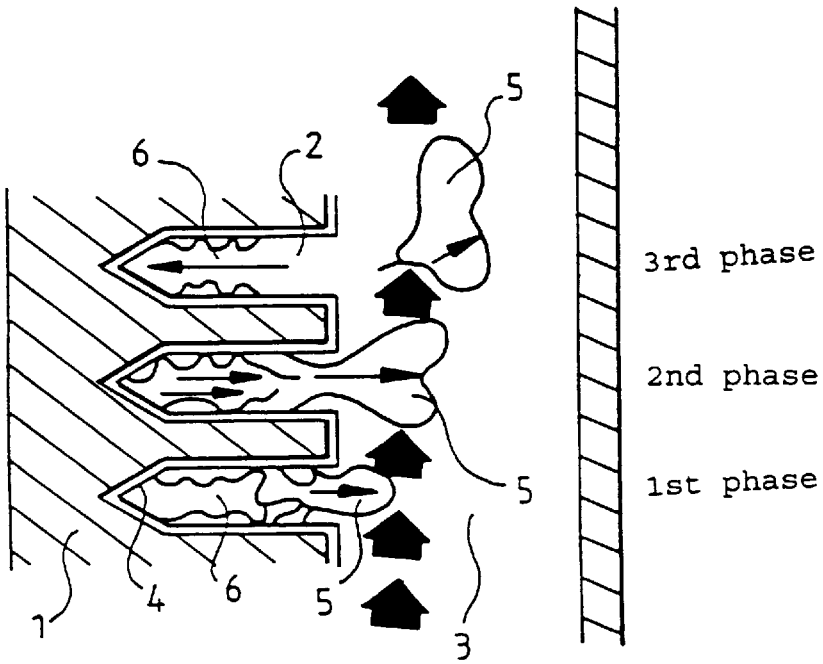
FIG. 1 RELATED ART
FIG. 1 represents a heat exchanger of the VAPOTRON type.

FIG. 1 represents a section of a heat exchanger of the VAPOTRON type.

The heat exchanger is formed by a wall 1 to be cooled, which has a succession of narrow slots 2 immersed in a stream 3 of liquid 6. The hottest portion 4 of the wall is at the base of the slots 2. The three slots 2 represented illustrate the three operating phases of the heat exchanger. During the first phase, the liquid enters a slot 2, is heated and vaporizes. Vapour bubbles 5 are formed. During the second phase, the vapour bubbles 5 escape from the slot 2 at high speed and this vapour is immediately condensed by the liquid stream 3. During the third phase, the slot 2 is resupplied with liquid 6 by suction between two vapour jets.

Figure 2:
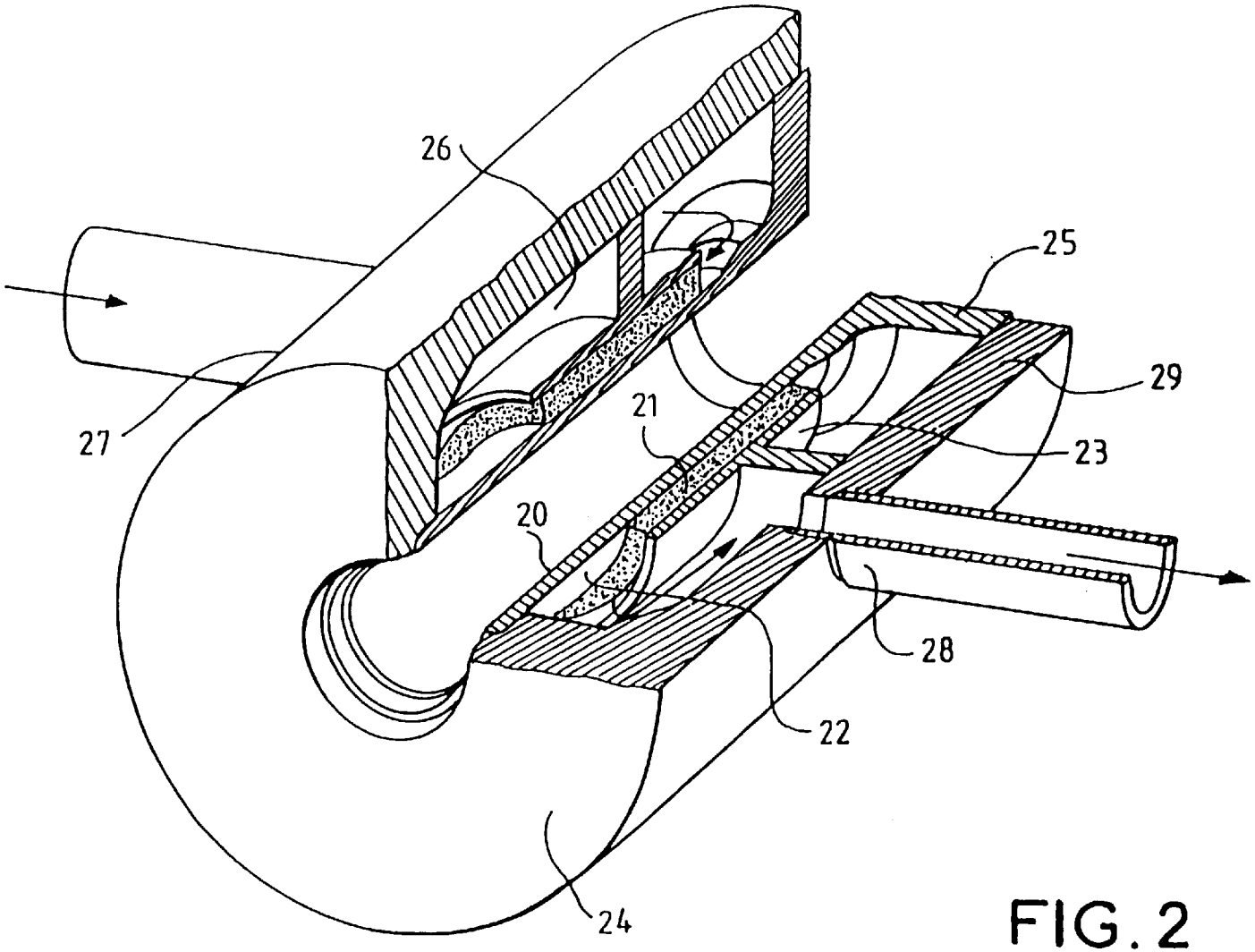
FIG. 2 represents a partial section of a heat exchanger according to the invention.

FIG. 2 represents an illustrative embodiment of a heat exchanger according to the invention. This heat exchanger includes a porous body 21 which is in contact with at least one portion of the part 20 to be cooled. A stream of fluid, which may be a gas or a liquid, flows through this porous body 21. In the example represented, the intention is to cool a cylindrical tube which may, for example, be a klystron drift tube, a gyrotron cavity or a tetrode anode. The porous body 21 has pores arranged so as to cause directional changes of the fluid as it passes through the porous body. It is made of a thermally conductive material. The temperature of the fluid injected is less than the temperature of the part 20 to be cooled. The porosity of the porous body is sufficiently high to allow the fluid to pass through with a head loss which is as small as possible. The pressure of the fluid before entering the porous body is slightly greater than that of the fluid on leaving the porous body 21. This heat exchanger may be used with the pressure and the flow rate of mains water distribution. It therefore does not require an installation with a compressor. Larger pressures and/or flow rates are also possible. Of course, the porous body has a mechanical strength which is compatible with the pressure and flow rate of the fluid.

In FIG. 2, the porous body 21, which is itself also cylindrical, is mounted coaxially around the part 20 to be cooled. The porous body 21 is contained in a housing 22 bounded by the part 20 to be cooled, by an external wall or skirt 29 and by two end walls 24, 25 which are substantially transverse to the porous body. In this example, the porous body 21 is held in the housing 22 with the aid of a ring 23, because a space 26 is formed between the porous body 21 and the skirt 29. The housing 22 includes one opening 27 for introduction of the fluid and another 28 for extraction of the fluid. In this example, these openings are arranged at the level of the skirt 29. The cooling fluid passes through the porous body and entirely fills the housing 22. Other arrangements for the openings are entirely envisageable.

Figure 3A:
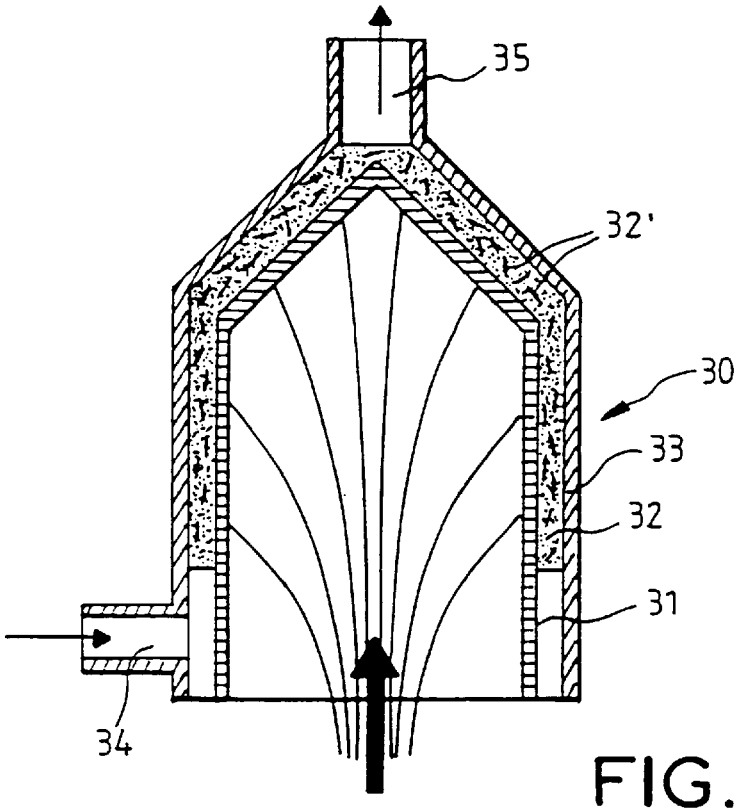
FIG. 3*a* represents a longitudinal section of a first variant of a heat exchanger according to the invention.

FIG. 3*a* represents a longitudinal section of a variant of a heat exchanger according to the invention. In this example, the heat exchanger is intended to cool a microwave electron tube collector 30. This collector is used for recovering the electrons produced in the tube when they have travelled their full distance. The trajectories of the electrons are represented inside the collector. The wall 31 of the collector is externally clad by the porous body 32. An outer wall 33 covers the porous body 32. In this variant, the outer wall 33 is in contact with the porous body 32. The porous body occupies most of the space between the wall of the collector 31 and the outer wall 33.

A first opening 34, for introduction of the fluid, is provided in the outer wall 33, for example at the level where the electrons enter the collector and a second 35, for extraction of the fluid, is provided, for example at the top of the collector. Other arrangements are entirely possible.

By virtue of the arrangement of its multiple pores, the porous body generates turbulence in the fluid stream. This fluid comes systematically into contact with the part to be cooled along chaotic non-laminar trajectories. The fluid is permanently agitated, which prevents the appearance of localized hot points in the porous body and at the surface of the part to be cooled. Problems associated with the formation of vapour bubbles immobilized at the surface of the part to be cooled are here minimized because the bubble aggregates are immediately destroyed by the structure of the porous body. The pores may be arranged in ordered fashion or else arbitrarily.

The porous body may be made with a honeycombed material with communicating cells 32'. This is illustrated in FIG. 3*a*. This honeycombed material may be made of metal, for example copper.

It is also possible to use interlaced wire for producing the porous body. The interlacing may be disordered, and in this case the pores are arbitrarily arranged, but they may be relatively ordered if the wire is, for example, knitted or woven. The wire may advantageously be made of copper, for example.

Figure 3B:
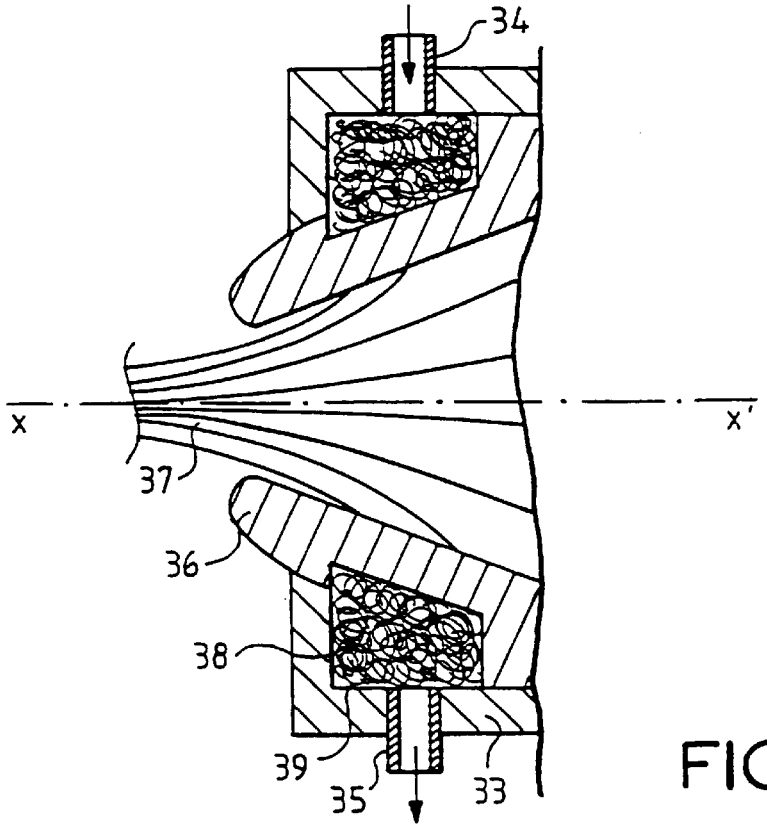
FIG. 3*b* represents a longitudinal section of a second variant of a heat exchanger according to the invention.

FIG. 3*b* shows a longitudinal section of a heat exchanger according to the invention, intended for cooling a klystron cavity port 36. The electron beam 37 produced in the klystron is directed along the axis x x' and passes through cavities (not represented) . Some cavity ports 36 intercept a portion of the electron beam 37 and must therefore be cooled. The porous body 38 is formed by interlaced wire. It is arranged in a housing 39 bounded by at least one portion of the cavity port 36 and by an outer wall 33 provided with openings 34, 35 for allowing injection and extraction of the fluid.

The cavity port 36 represented in this example is substantially conical.

Figure 3C:
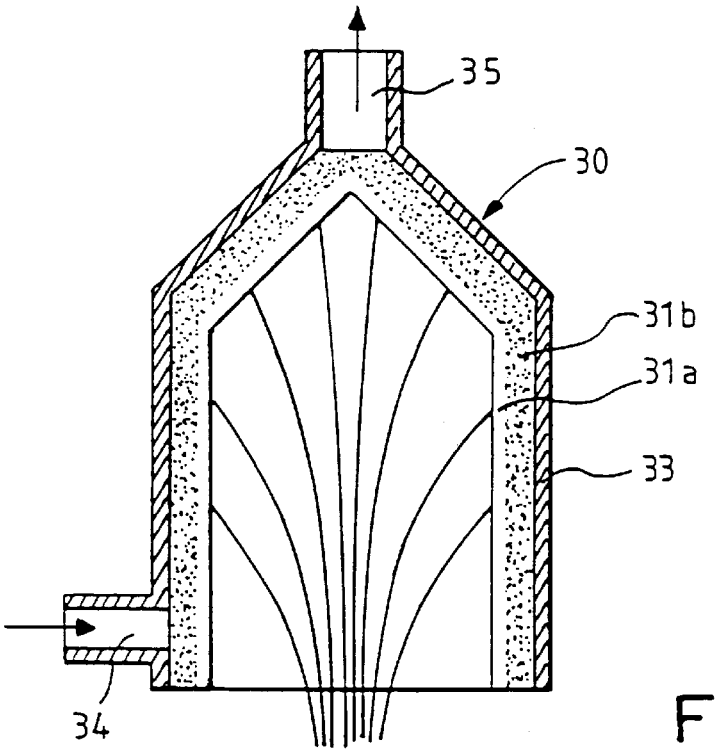
FIG. 3*c* represents a longitudinal section of a third variant of a heat exchanger according to the invention.

In the embodiments described so far, the porous body was fitted in contact with the part to be cooled. It is possible for the part to be cooled and the porous body to form an integral unit. This is illustrated in FIG. 3*c*. This figure represents a longitudinal section of a heat exchanger for a collector, which is comparable to that in FIG. 3*a*. The wall 31 of the collector 30 is now formed internally by a solid portion 31*a* and externally by a porous portion 31*b*. The solid portion 31*a* is leaktight, whereas the fluid passes through the porous portion 31*b*. As in FIG. 3*a*, the outer wall 33 is in contact with the porous portion 31*b* and the openings 34, 35 for ensuring circulation of the fluid.

Figures 6A, 6B:
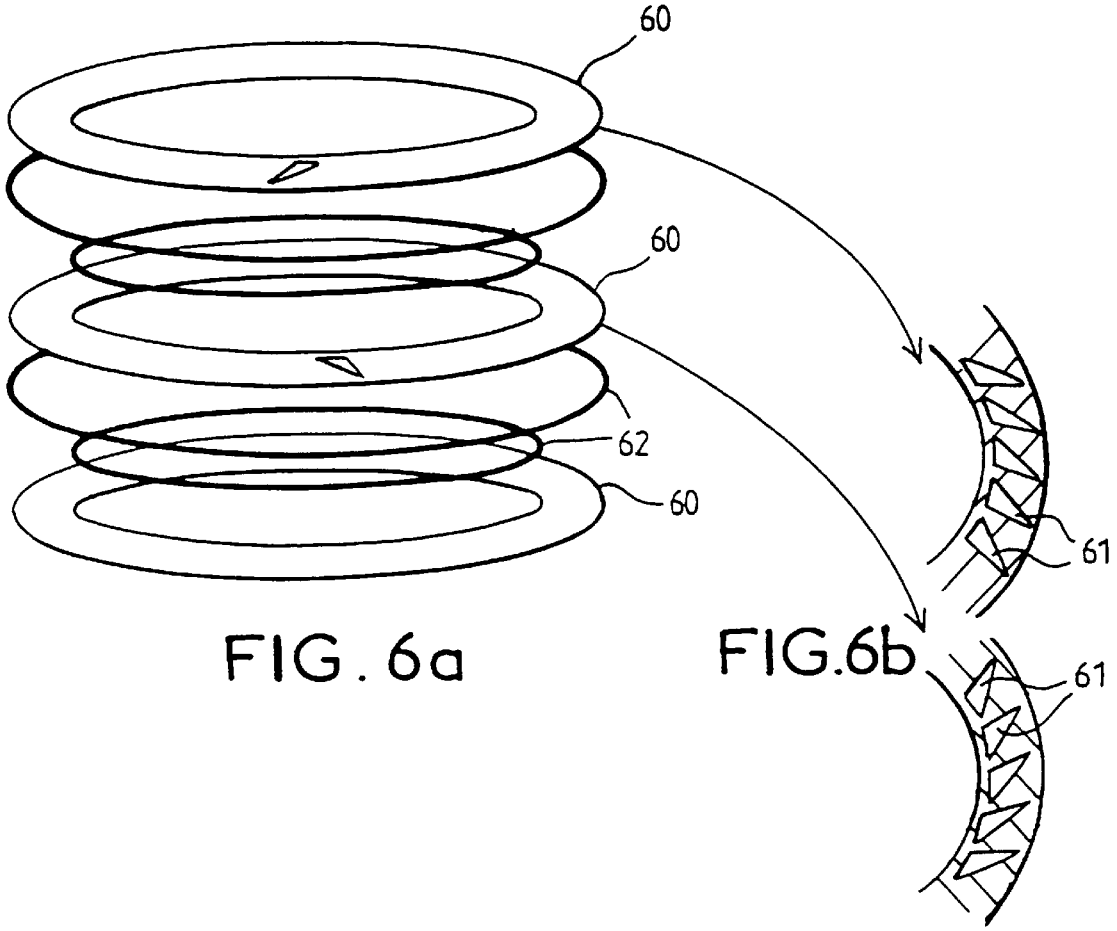
FIG. 6*a* represents an exploded view of yet another variant of a porous body of a heat exchanger according to the invention.
FIG. 6*b* represents an enlarged detail of this porous body.

FIG. 6*a* represents an exploded view of another configuration of a porous body of a heat exchanger according to the invention. It may be used in a heat exchanger such as the one in FIG. 2.

This porous body includes a succession of partitions 60 pierced with openings 61. The partitions 60 are separated by spacers 62. For this type of heat exchanger, the partitions are in the form of washers. The openings 61 are distributed over the entire surface area of the partitions 60. They are represented enlarged in FIG. 6*b*. These openings 61, preferably substantially identical, have a larger surface area close to the part to be cooled (which is not represented but would be located at the centre of the washers) than close to the outer edge. The openings are inclined with respect to the radius of the washer and this inclination is produced with different directions for two successive partitions 60. The fluid is therefore deviated several times when passing through the porous body.

The porous body may also advantageously be produced with a plurality of elements pierced with at least one hole and arranged in contact with one another. These elements may all be identical. It is possible, for example, to use small tubes made of thermally conductive material, for example copper. These elements are preferably assembled with one another. They then form an agglomerate. They may, for example, be assembled by hard soldering.

Figure 4:
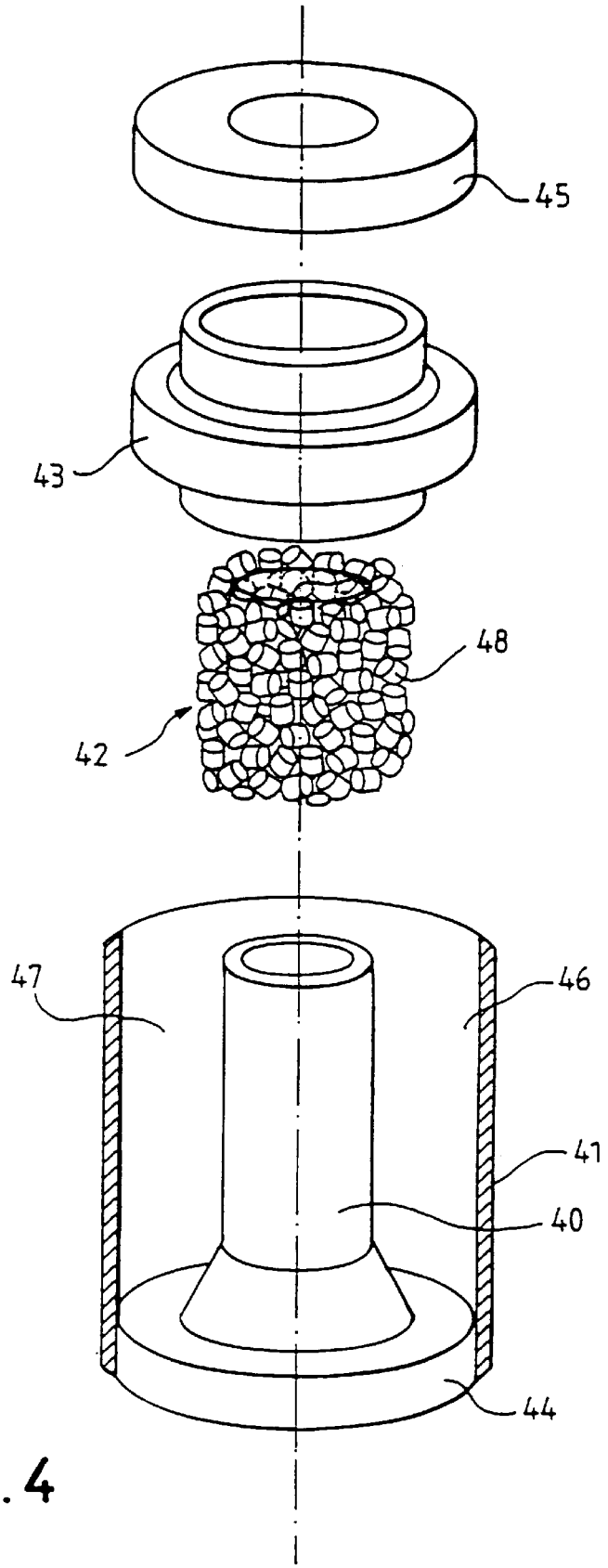
FIG. 4 represents another variant of a heat exchanger according to the invention.

FIG. 4 represents an exploded view of a heat exchanger according to the invention. From the structural point of view, it is comparable with the one in FIG. 2. Reference 40 denotes the part to be cooled, which may here again be a klystron drift tube, a gyrotron cavity or a tetrode anode. This part is cylindrical. The porous body 42, in the form of a hollow cylinder, is formed by a multitude of small tubes 48 assembled with one another. As in FIG. 2, the skirt 41, the holding ring 43 intended to be housed between the porous body 42 and the skirt 41, the space 46 formed between the porous body 42 and the skirt 41 and the transverse walls 44, 45 which close the housing 47 bounded by the skirt 41 and the part 40 to be cooled, are seen. For the sake of clarity, the fluid inlets and outlet are not represented.

Advantageously, the tubes 48 of the hollow body 42 have a height substantially equal to their diameter. These dimensions make it possible to prevent them from being placed in orderly fashion in the cavity by grouping along one of their generatrices. They are placed arbitrarily when they are poured into a cavity. It would also be possible to arrange them in ordered fashion in the cavity, while still providing directional changes of the fluid, but this method is less simple.

The volume of material corresponding to all these elements is small compared to the volume which they occupy, so as to allow the fluid to pass through with a head loss which is as small as possible. This head loss will preferably be less than 3 bar.

The thickness of the material of the elements is chosen to be as thin as possible.

For example, in the case of tubular elements, they may be given a diameter and a height of the order of one millimeter and a thickness of the order of one tenth of a millimeter. The thickness represents the difference between the internal radius and the external radius.

In contrast, the arrangement will be such that the sum of the surface areas of all these elements in contact with the fluid is greater than the surface area of the part to be cooled, in contact with the porous body.

Such a porous body is particularly simple to produce. It is furthermore suitable for any desired shape. Such a heat exchanger makes it possible to cool parts with complex shapes, it being sufficient to build a housing which uses at least a portion of the part to be cooled as its wall and to fill it at least partially with small elements pierced with at least one hole, for example by pouring them.

Trials have made it possible to test such heat exchangers under a continuous heat-flux density of 6 $kW/cm^2$. These performances are much better than those of heat exchangers of the VAPOTRON type, for a slightly greater pressure (of the order of one to two times more) and a lower flow rate. They are comparable with those of forced-circulation heat exchangers, without requiring the installation to deliver the forced fluid stream. The fluid flow rate used is typically of the order of one quarter of that of forced-circulation exchangers, and the pressure is of the order of a half, with a temperature of the hot part which is itself also halved. These performances make it possible to reduce the size of the heat exchanger and the surface area to be cooled.

Figure 5:
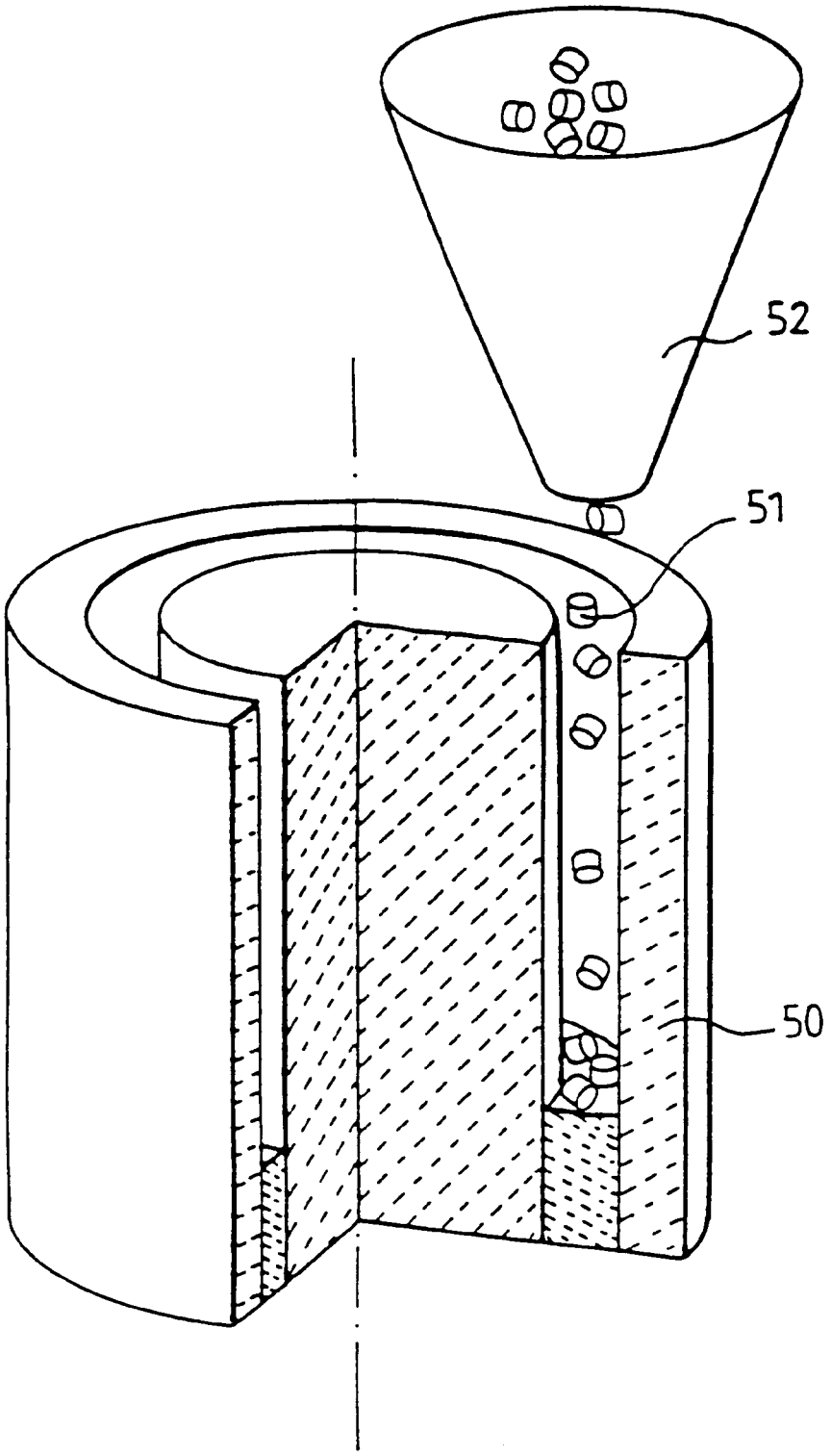
FIG. 5 represents a method for producing a porous body of a heat exchanger according to the invention.

FIG. 5 illustrates a method for producing a porous body of a heat exchanger according to the invention, if it is produced out of the system to be cooled.

This method consists in placing elements 51, pierced with at least one hole, in a mould 50 made of refractory material (for example ceramic). The internal volume of the mould has the shape and dimensions desired for the porous body. The pierced elements are poured into the mould 50 using a funnel 52, for example. The mould 50 is then heated so that the elements 51 agglomerate by sintering. After cooling, the agglomerated pierced elements form the porous body.

These elements may be made of copper for example. It is also possible to cover this first material with a second material, the melting temperature of which is lower than that of the first material, so that assembly takes place at a lower temperature, by hard soldering typically at 1030° C. Silver or gold may be used as the second material if the first material is copper, by deposition on the elements before hard soldering, or in the form of a filler.

Instead of using a mould, it is possible to pour the pierced elements directly into a cavity bounded by at least the part to be cooled.

The examples described use various types of porous body and various parts to be cooled. It is clearly possible to combine the porous bodies and the parts to be cooled in a different fashion without departing from the scope of the invention.

We claim:

1. Fluid-circulation heat exchanger intended to cool a part which includes, in contact with at least one portion of the part to be cooled, a porous body, made of a thermally conductive material, through which a fluid flows, the porous body including a plurality of elements each of the plurality of elements having at least one hole pierced therethrough and are in thermal contact with one another, wherein the elements being arranged in random directions so as to generate directional changes of the fluid.

2. Heat exchanger according to claim 1, wherein the plurality of elements are fixed to one another.

3. Heat exchanger according to claim 1, wherein the plurality of elements are tubular and have a height substantially equal to their diameter.

4. Heat exchanger according to claim 1, wherein the plurality of elements have a thickess which is as small as possible while maintaining structural integrity during cooling of the part to be cooled.

5. Heat exchanger according to claim 1, wherein the porous body is placed in a fluid-filled housing, one wall of which is formed at least partially by the part to be cooled.

6. Heat exchanger according to claim 5, further comprising a space formed between the porous body and at least one wall of the housing other than the one formed by the part to be cooled.

7. Heat exchanger according to claim 1, wherein the fluid is water having a pressure greater than or equal to that of a mains distribution network.

8. Heat exchanger according to claim 1, wherein the part to be cooled is a portion of an electron tube.

9. Heat exchanger according to claim 1, wherein the plurality of elements are made on the basis of a metal having high thermal conductivity.

10. Heat exchanger according to claim 9, wherein the metal is covered with a material having a lower melting point than the metal.

11. Method for manufacturing a porous body of a heat exchanger according to claim 1, wherein the method consists in placing the plurality of elements having at least one hole pierced therethrough in a cavity, then in heating the cavity so that the elements agglomerate.

12. Method of manufacture according to claim 11, wherein the method consists in covering the plurality of elements having at least one hole pierced therethrough with a material having a lower melting temperature than the material of which the elements are made.

13. Method of manufacture according to claim 11, wherein the method consists in forming the cavity via the interior of a mould made of refractory material.

14. Method of manufacture according to claim 11, wherein the method consists in cavity being bounded at least partially by the part to be cooled.

15. Heat exchanger according to claim 2, wherein the plurality of elements are tubular and have a height substantially equal to their diameter.

16. Heat exchanger according to claim 2, wherein the plurality of elements have a thickness which is small compared to their height.

17. Heat exchanger according to claim 3, wherein the plurality of elements have a thickness which is small compared to their height.

18. Heat exchanger according to claim 2, wherein the porous body is placed in a fluid-filled housing, one wall of which is formed at least partially by the part to be cooled.

19. Heat exchanger according to claim 3, wherein the porous body is placed in a fluid-filled housing, one wall of which is formed at least partially by the part to be cooled.

20. Heat exchanger according to claim 4, wherein the porous body is placed in a fluid-filled housing, one wall of which is formed at least partially by the part to be cooled.

* * * * *